United States Patent [19]

Bagley

[11] Patent Number: 4,967,982

[45] Date of Patent: Nov. 6, 1990

[54] LATERAL THRUSTER FOR MISSILES

[75] Inventor: Cloy J. Bagley, Fountain Valley, Calif.

[73] Assignee: General Dynamics Corp., Pomona Division, Pomona, Calif.

[21] Appl. No.: 267,583

[22] Filed: Nov. 7, 1988

[51] Int. Cl.[5] ..... F42B 10/66

[52] U.S. Cl. ..... 244/3.22

[58] Field of Search ..... 244/3.22; 239/265.19, 239/265.25, 265.27

[56] References Cited

U.S. PATENT DOCUMENTS

| | | | |
|---|---|---|---|
| Re. 23,936 | 2/1955 | Winslow . | |
| 2,085,370 | 6/1937 | Kirkpatrick . | |
| 2,214,656 | 9/1940 | Briggs . | |
| 2,552,359 | 5/1951 | Winslow . | |
| 2,822,755 | 2/1958 | Edwards et al. . | |
| 2,922,367 | 1/1960 | Dunzer . | |
| 2,938,459 | 5/1960 | McGraw et al. . | |
| 2,995,319 | 8/1961 | Kershner et al. . | |
| 3,057,581 | 10/1962 | Tumavicus . | |
| 3,070,329 | 12/1962 | Hasbrouck . | |
| 3,115,318 | 12/1963 | Caillette . | |
| 3,180,084 | 4/1965 | Meeks . | |
| 3,188,024 | 6/1965 | Schneider . | |
| 3,249,325 | 5/1966 | Forehand . | |
| 3,286,956 | 11/1966 | Nitikman . | |
| 3,446,436 | 5/1969 | Desjardins et al. . | |
| 4,646,991 | 3/1987 | Kranz | 244/3.22 |
| 4,684,080 | 8/1987 | Pinson | 244/3.22 |
| 4,763,857 | 8/1988 | Booth et al. | 244/3.22 |

FOREIGN PATENT DOCUMENTS 0069440 1/1983 European Pat. Off. .

*Primary Examiner*—Charles T. Jordan

*Attorney, Agent, or Firm*—Henry Bissell; Leo R. Carroll

[57] ABSTRACT

A lateral thruster for missiles is provided which comprises two or more individually rotatable thruster motors with integral nozzles. If the thrusters are located at or near the center of gravity of the missile, the missile can be maneuvered while it remains pointed at the target. Locating the thrusters forward or aft of the missile center of gravity enables steering forces as well as lateral translational and roll forces to be provided. The thruster motors need not be disposed in pairs. The use of integral nozzles obviates sealing problems and allows mountings that permit rapid rotation of the thruster motors to improve missile response time. The lateral thruster disclosed is effective at nearly all aerodynamic angles of attack, missile velocities, and altitudes. The thruster as a unit is enclosed by a shroud that blends into the missile body contour. Possible propellants for the thruster motors include solid propellants and compressed gases. The thruster motors can be rotated using electrical motors or pneumatic actuators.

25 Claims, 3 Drawing Sheets

LATERAL THRUSTER FOR MISSILES

BACKGROUND OF THE INVENTION

1. Field of the Invention

This invention relates to devices for producing forces on a missile in flight and, more particularly, to a lateral thruster used to produce a lateral force which can be controlled in magnitude and direction and can be used to translate the missile laterally and/or provide steering.

2. Description of the Related Art

One of the basic goals of the technology of missile flight is to improve both the maneuverability of the missile and its response time. In discussing possible improvements it is appropriate to consider a typical missile that uses aerodynamic forces for both steering and maneuvering. The steering forces are those that are used to control the pitch, yaw, and roll of a missile.

The maneuverability of a missile is related to its ability to change its flight path. Since lateral forces cause a missile to change its flight path, the maneuverability of a missile is related to its ability to develop lateral forces. Aerodynamic lateral forces are created on a missile when the missile is made to fly at what is known as an aerodynamic angle of attack, i.e., at an angle relative to its flight path. This is achieved by applying steering forces that are typically created by deflecting control surfaces that are forward or aft of the missile center of gravity.

Aerodynamic lateral forces due to angle of attack and aerodynamic steering forces decrease dramatically with missile velocity and with altitude. These forces also reach maxima with aerodynamic angle of attack and with control surface deflection angle. Control surfaces are often not very effective when the missile is at a high aerodynamic angle of attack.

It would be a great boon to the technology of missile flight control if there existed thrusters that could produce lateral forces and steering forces that were essentially independent of missile aerodynamic angle of attack, missile velocity and altitude, and, in the case of steering forces, independent of control surface deflection angles.

The response time of a missile is a measure of how fast it can execute a maneuver, which is related to how rapidly lateral forces can be developed. For a typical missile a maneuver sequence starts with the deflection of control surfaces. This provides steering forces which cause the missile to pitch or yaw to an aerodynamic angle of attack which produces the necessary lateral forces. It would lead to a great improvement in missile response time if lateral forces could be developed without any delay for the missile to develop an aerodynamic angle of attack.

Some examples of the related art are discussed below.

U.S Pat. No. 3,446,436 to Desjardins et al discloses a rocket thrust nozzle system in three embodiments. The first is directed to a main rocket motor with four secondary motors fixedly attached around it. The forward longitudinal thrust of the main rocket motor is deflected by means of secondary injection to provide steering forces to the missile. The steering forces end when the main motor thrust ends. The secondary motors provide longitudinal thrust only, with no provision to provide steering forces. Their thrust is turned by use of canted nozzles to impinge on a rearwardly convergent cone. The first embodiment disclosed provides what is generally known as thrust vector control to the forward longitudinal thrust of a main rocket motor and provides additional longitudinal thrust by means of what are generally known as strap-on boosters.

In the second embodiment the canted nozzles on the secondary motors have been made rotatable to provide steering forces, including roll control, to the missile. The nozzles rotate while the rocket motor casings remain fixed to the main rocket. The second embodiment provides what is generally known as thrust vector control to the forward longitudinal thrust of what are generally known as strap-on boosters.

In the third embodiment the rotatable nozzles have been inserted into the base of the main motor casing with the intent of providing steering forces to the forward longitudinal thrust of the main motor. This approach is generally described as thrust vector control by means of multiple nozzles.

The secondary motors can only be located at the aft end of a missile, clearly aft of the missile center of gravity. At this location they can only provide steering forces that are opposite to the direction desired for the missile. In addition, the secondary motors can only be located generally external to the missile body. The nozzles on the secondary motors rotate with the motors remaining fixed.

European patent application No. 0,069,440 by Young is directed toward a gas thruster device that utilizes a pair of rotatable nozzle assemblies for discharging gas to control the flight of a missile by providing pitch, yaw, and roll steering forces. When the propellant ignites in the combustion chamber, the gases travel rapidly through the duct leading to the nozzle. At the end of the duct the gases are turned through 90° before being expelled through the nozzle.

U.S. Pat. No. 3,286,956 to Nitikman relates to an integrated control system with a common actuation means for reaction or reaction plus aerodynamic control of a multi-phase or multi-stage rocket vehicle. A plurality of movable aerodynamic control surfaces extend fore and aft of a missile body adjacent to the exterior surface thereof. Each of the surfaces has a relatively flat, pointed forward edge and a relatively thick, blunt trailing edge. A rocket nozzle mounted within each of the control surfaces has its mouth directed rearwardly along the blunt edge. A rocket motor mounted within the missile has a single outlet to which a manifold is attached.

U.S Pat. No. 2,552,359 to Winslow, Reissue 23,936, discloses a method for effecting attitude control of aircraft, and particularly to a method by the pilot of directing the aircraft attitude, including means for automatic control of angular acceleration of the aircraft to bring about the attitude directed by the pilot. A mechanical means for accomplishing directional control consists of an arrangement of four thrust-producing units which assist in the angular movement of the aircraft about any one or combination of its three principal axes and provide forces of thrust as a means of propulsion.

U.S. Pat. No. 2,822,755 to Edwards et al describes a mechanism for causing a missile to maintain a desired heading regardless of the cooperation of external forces that would cause deviation from its intended path. A plurality of jets uniformly spaced about the periphery of a rocket are provided which derive their gases from that propelling the rocket, the jets being selectively controlled by a gyroscope-actuated mechanism for rotating the rocket about its center of gravity, thus maintaining the rocket on, or parallel to, its intended heading.

U.S. Pat. No. 2,938,459 to McGraw et al relates to a gimbal bearing or universal type bearing for carrying a thrust load between two members. The gimbal bearing is designed for use in guided missiles as a means of permitting the universal movement of rocket engines therein and, at the same time during flight, to receive their thrust.

U.S. Pat. No. 2,995,319 to Kershner et al relates to a pre-boost control device for an aerial missile which utilizes a plurality of jet reaction nozzles to control the roll, pitch, and yaw attitude of a missile. Four small reaction nozzles are mounted at the rear of the missile and carried in bearings in such a way that the direction of pointing of their jets can be altered. Hot high-pressure gas is supplied to the nozzles by the products of combustion of a propellant housed in a chamber common to all of the nozzles. The nozzles are mechanically linked to the missile tail fins in such a way that deflection of the tail fin rotates the nozzle attached to that fin to provide a turning moment on the missile in the same direction as would result from the aerodynamic moment of the deflected tail fin.

U.S Pat. No. 3,057,581 to Tumavicus discloses a rocket vectoring arrangement comprising a plurality of rockets or nozzles mounted at substantial distances from a vehicle axis, such that when the axes of the several nozzles or rockets are parallel to the vehicle axis, the discharge ends of the nozzle are spaced apart radially so that vectoring of some of the nozzles in any direction may occur.

U.S. Pat. No. 3,070,329 to Hasbrouck is directed toward the use of a plurality of independently movable steering rockets by which to impart to a main rocket or vehicle a steering thrust at an acute angle to the line of thrust of the main propulsive nozzle. The steering rockets are arranged external to the vehicle in such a way that the resulting steering thrust may be at any angle desired, with the steering rockets normally extending axially and supplementing the thrust of the main nozzle.

U.S. Pat. No. 3,115,318 to Caillette relates to the maintenance of any desired direction of flight of rocket or jet propelled flying bodies and more particularly to aircraft including pilotless missiles utilizing jet thrust for flying both vertically and horizontally. A flying body is provided with any suitable number of angularly adjustable thrust-producing units for the dual purpose of providing force of thrust as a means of propulsion and as a means of constantly maintaining any desired direction of flight.

U.S. Pat. No. 3,180,0B4 to Meeks is directed toward a thrust device comprising a spherical container made of lightweight metal and filled with a propellant gas under relatively high pressure. The container is formed with diametrically aligned hubs forming coaxially extending cylindrical openings. A valve unit is slidably fitted in the openings in the hubs to form a complete self-contained thrustor unit. The disclosed construction enables the container to expand and contract in accordance with temperature and pressure differentials in such a way that the valve unit is not subject to strain resulting from distortion of the container.

U.S. Pat. No. 3,188,024 to Schneider is directed toward an aircraft steering and propulsion unit utilizing pivotally mounted reaction motors so that the direction of the exhaust of those motors can be directed to intersect and thereby increase the propulsion of the craft in rarefied atmosphere. The pivotally mounted reaction engines can also be used to provide a deceleration effect on a spacecraft as it re-enters the atmosphere.

U.S. Pat. No. 3,249,325 to Forehand discloses a missile guidance system including combined steering and propulsive means for steering missiles upon a predetermined trajectory by a gyroscope control means for adjustably positioning combined steering and propulsion nozzles carried by the missile.

None of the patents or patent applications described above is directed to a configuration of thruster motors which provide mainly lateral thrust; which can be located to act aft of, forward of, or at the missile center of gravity; which can be buried in the missile body to reduce aerodynamic drag and accommodate launching from canister-type launchers; and which operate completely independently of the forward longitudinal thrust of the main rocket motor without using secondary injection methods to alter the direction of thrust. None discloses an arrangement of rotatable thruster motors with integral nozzles to eliminate sealing problems and thrust plate or ring friction forces, and with drive assemblies which are well protected from hot exhaust gases.

SUMMARY OF THE INVENTION

In accordance with the present invention a lateral thruster for missiles is provided which comprises two or more individually rotatable thruster motors with integral nozzles. In a first arrangement the thrusters act at or near the center of gravity of the missile, which causes the missile to be translated laterally with little or no pitch or yaw. This allows maneuvering of the missile while it remains pointed at the target. Other embodiments are possible in which the thrusters are located forward or aft of the missile center of gravity where they would provide steering forces as well as lateral translational forces.

The thruster motors need not be disposed in pairs; an arrangement of three thruster motors is viable, for example. The use of individual thruster motors with integral nozzles obviates sealing problems and allows mountings that permit rapid rotation of the thruster motors. Missile response time is thus improved. For exceptionally fast response the thruster motors can be rotated to an anticipated position even before they are ignited. The thrusters are effective at nearly all aerodynamic angles of attack, missile velocities, and altitudes.

Each thruster motor is rotated by an electrical motor acting through a gear train. The electrical motors are powered by batteries which may be housed in the thruster section or elsewhere. A supporting structure consists of end plates, webs between the thruster motors, and a mounting plate to support the electrical motors and gear trains. The thruster as a unit is enclosed by a shroud that blends into the missile body contour. Possible propellants include solid propellants and compressed gases. Other means of rotating the thruster motors include those using pneumatic actuators or electric torque motors.

BRIEF DESCRIPTION OF THE DRAWINGS

A better understanding of the present invention may be realized from a consideration of the following detailed description, taken in conjunction with the accompanying drawing in which.

DESCRIPTION OF THE PREFERRED EMBODIMENTS

Figure 1A:
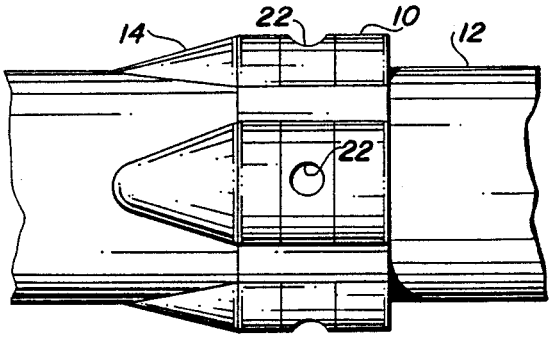
FIG. 1A is a side elevational view of a lateral thruster forming a section of a missile body (only part of which is shown)
Figure 1B:
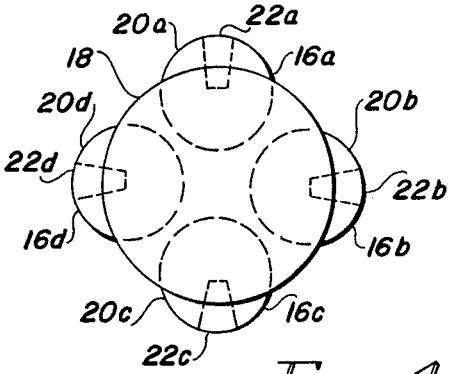
FIG. 1B is a schematic diagram of the thruster as seen along a longitudinal axis of the missile.

Referring to FIG. 1A, a lateral thruster 10 is shown forming a section of the body of a missile 12. A smooth aerodynamic transition to the contour of the missile body 12 is afforded by a shroud 14 which joins body 12 to lateral thruster 10. FIG. 1B, which shows the lateral thruster in a schematic diagram as seen looking along a longitudinal axis of the missile, depicts an arrangement in which four thruster motors 16a–16d are symmetrically disposed about the longitudinal axis in a structural framework 18. Each thruster motor 16 comprises a propellant storage chamber 20 with an integral nozzle 22 which allows a thrust-producing escape of propellant in a direction substantially perpendicular to the longitudinal axis of the missile. Each thruster motor 16 is independently rotatable about an axis substantially parallel to the longitudinal axis, so that the direction of propellant escaping through a nozzle can be varied over an angular range in a plane perpendicular to the longitudinal axis of the missile. For maximum effectiveness in creating lateral thrust forces on the missile, the centers of gravity of the thruster motors 16 are arranged in a plane containing the center of gravity of the missile which is oriented perpendicular to the longitudinal axis of the missile.

Figure 2:
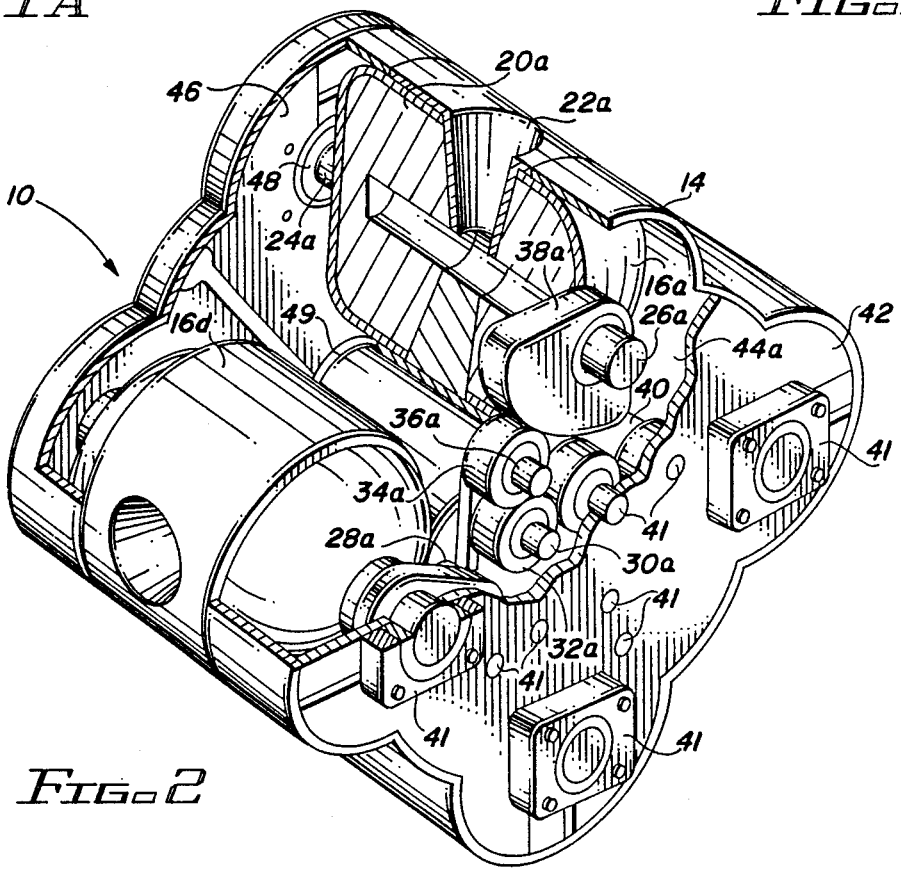
FIG. 2 is a perspective drawing, partly broken away, of the lateral thruster.

FIG. 2 is a perspective view of a partly broken away lateral thruster 10. Thruster 10 in FIG. 2 is shown as if it were an integral part of missile body 12, partly for purposes of ease in illustration. It should be kept in mind that thruster 10 could be designed to have a central aperture part for a missile body 12 so that the thruster motors 16 would be more widely separated.

Thruster motor 16a comprises a propellant storage chamber 20a, an integral nozzle 22a, and axial end rods 24a, 26a. Thruster motor 16a is able to rotate as a unit about an axis concentric with axial end rods 24a, 26a, thus allowing the direction of propellant escaping through nozzle 22a to vary over an angular range defined by the rotation of the thruster motor. An electrical drive motor 28a has an output shaft 30a on which a drive gear 32a is mounted. An idler gear 34a mounted on idler gear shaft 36a transmits rotational motion to rotator gear 38a mounted on axial end rod 26a. Drive motor 28a is mounted on mounting plate 40 and drive shaft 30a, idler gear shaft 36a, and axial end rod 26a are all accommodated in bearings 41 mounted in a first end plate 42. Idler gear shaft 36a is also accommodated by bearings mounted in mounting plate 40. A web plate 44a separates thruster motors 16a and 16b (thruster motors 16b and 16c are hidden from view in FIG. 2). A second end plate 46 has a set of bearing mounts 4B in it which hold the ends of axial end rods 24a–24d which are opposite first end plate 42. Battery housing 49 contains a source of electrical energy to power the drive motors 28.

The lateral thruster 10 depicted in FIG. 2 forms a section of a missile body. Normally the section of the missile body formed by thruster 10 will be just forward of the main rocket motor.

Figure 3A:
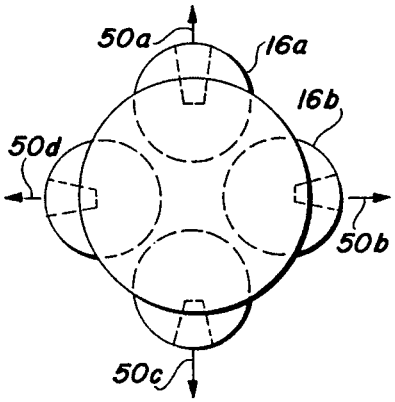
FIGS. 3A–3E are schematic diagrams of a lateral thruster arrangement with four thruster motors mounted symmetrically with respect to a central longitudinal axis of a missile, showing nozzle configurations giving rise to (a) no lateral force, (b) a lateral force, (c) a larger lateral force at a different missile roll orientation, (d) a lateral force at yet another missile roll orientation, and (e) roll moment without lateral force, respectively.
Figure 3B:
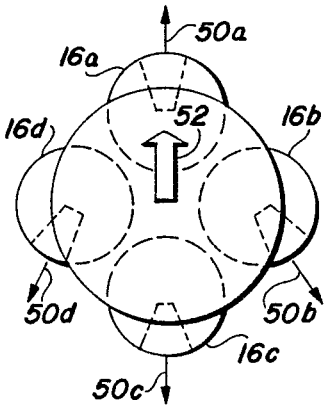
Figure 3C:
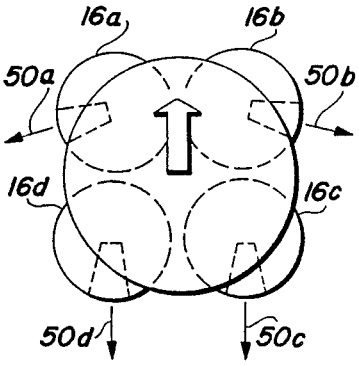
Figure 3D:
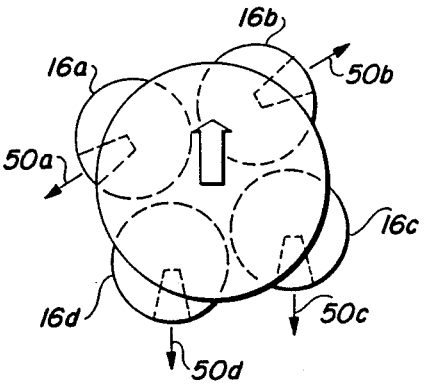
Figure 3E:
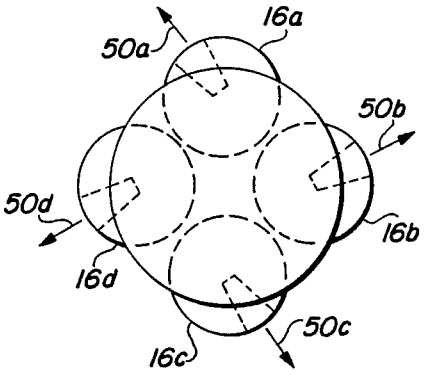

FIG. 3A depicts a configuration of the four thruster motors 16a–16d for which there is no net lateral force on the missile if the individual thrusts 50a–50d are all equal. In FIG. 3B a net lateral force vector 52 is obtained for the same missile roll orientation as in FIG. 3A after rotation of two of the thruster motors, 16b and 16d. It can be seen that the individual thrusts 50b and 50d have downward components which add to produce the upward lateral force 52 on the missile In FIG. 3C a different missile roll orientation is shown and all four thruster motors have been rotated. A net upward lateral force on the missile is produced by the sum of the downward thrusts 50c and 50d added to the sum of the small downward components of thrusts 50a and 50b. Because of the symmetry of the thrusts shown in FIGS. 3B and 3C, there is no net roll moment applied to the missile in either case. FIG. 3D illustrates how lateral force can be produced without causing roll moment at yet another, less intuitive, missile roll orientation. The downward thrusts 50c and 50d produce a net upward force since the lateral force components produced by thrusts 50a and 50b cancel. Net roll moment is not produced because the roll moments produced by thrusts 50a and 50c cancel and the roll moments produced by thrusts 50b and 50d cancel. FIG. 3E illustrates how roll moment without lateral force can be produced. The thruster motors and hence thrusts 50a–50d are rotated in the same direction and by the same amount. The lateral forces all cancel and net roll moment is produced. Roll control moments can be provided no matter where the thruster 10 is located along the length of the missile. Combined lateral force and roll moment can be produced by superimposing roll control as shown in FIG. 3E on lateral force producing orientations such as are shown in FIGS. 3B–3D. In practice, a small amount of angular rotation capability of each thruster motor 16a–16d could be reserved for roll control.

The lateral force and roll moments discussed relative to FIGS. 3B–3E assume that the individual thrusts 50a–50d are equal and that they do not alter the normal aerodynamic forces. In reality this is not so. To accommodate or negate these effects, however, the thruster motors could be rotated individually as required. In practice a small amount of angular rotation capability of each thruster motor 16a–16d could be reserved for this function.

Figure 4:
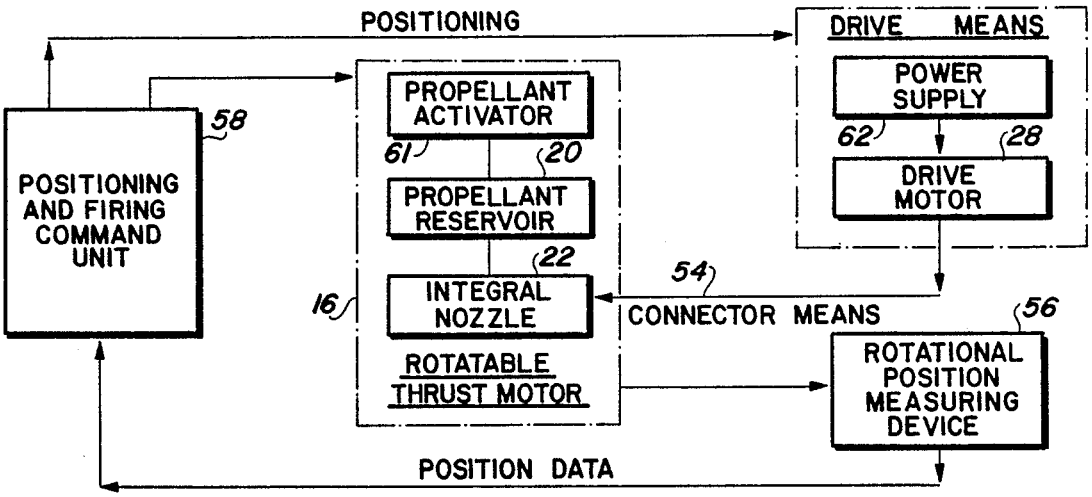
FIG. 4 is a schematic block diagram of a lateral thruster missile system.

FIG. 4 is a schematic block diagram illustrating the interrelationship between a drive motor 28, a rotatable thruster motor 16, rotation connecting means 54, a rotational position measuring device 56, and a source of positioning and firing commands 58. The main components of rotatable thruster motor 16 are propellant reservoir 20, a propellant activator 61, and integral nozzle 22. In the case of a solid propellant, propellant activator 61 would be some sort of igniter. If the propellant were a gas under pressure, propellant activator 61 would be an electrically or pneumatically operated valve to allow the gas to escape through integral nozzle 22.

The control of lateral thruster 10 is represented in functional block form in FIG. 4. A source of positioning and firing commands 58 sends positioning control signals to drive motor 28 and firing control signals to rotatable thruster motor 16. Specifically, firing control signals are sent to propellant activator 61 which forms part of propellant reservoir 20. The angular orientation of rotatable thruster motor 16 is sensed by rotational positioning measuring device 56 which sends positional data to the source of positioning and firing commands 58. Drive motor 28, powered by power supply 62, controls the angular position of rotatable thruster motor 16 through connecting means 54, which mechanically transmits the rotational motion of drive motor 28 to thruster motor 16. The diagram in FIG. 4 is a simplified version because it describes only a single drive motor and thruster motor combination. Control of a lateral thruster 10 actually involves a plurality of thruster motors and the control arrangement used must coordinate the rotation and firing of the plurality of thruster motors to effect various results, including the production of lateral thrust forces and steering forces.

Figure 5:
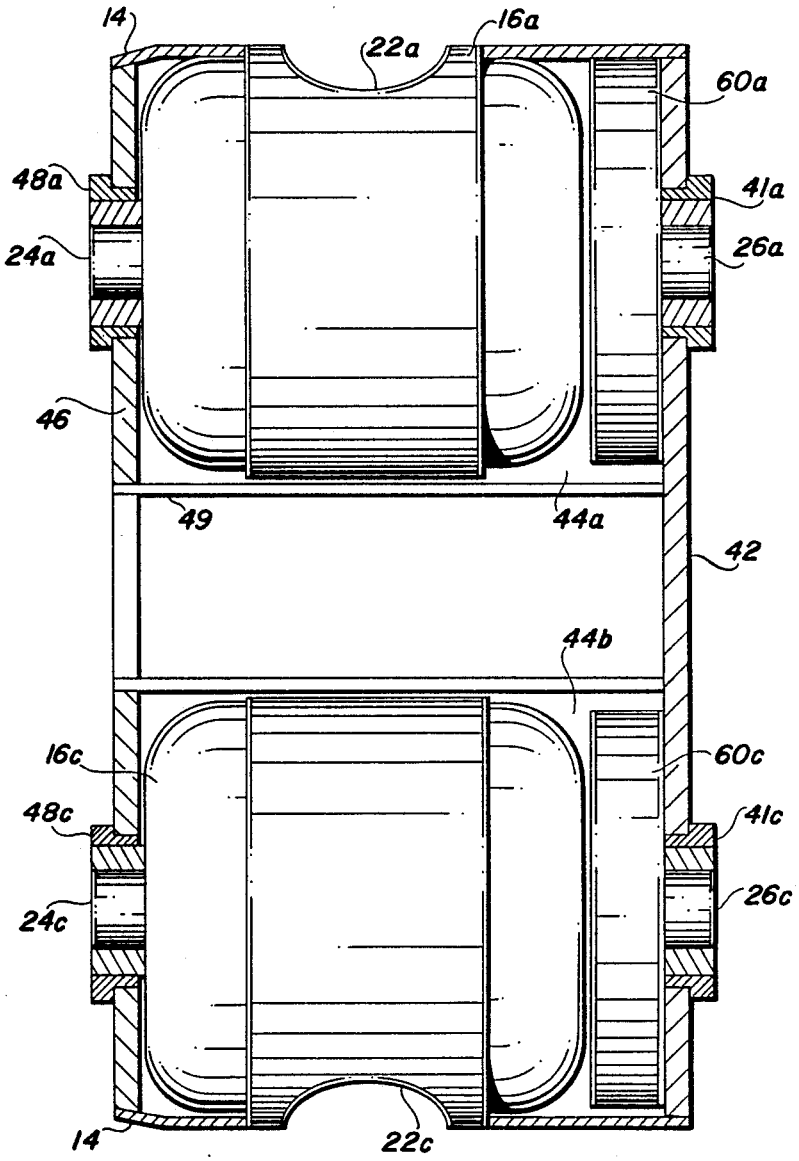
FIG. 5 is a side elevational view showing a thruster, partially cut-away, with direct torque electric motors for rotating the thruster motors.

Various arrangements of gear trains can be envisioned, some less complicated than shown in FIG. 2 and some more complicated. The low rotational friction characteristics of the thruster motor mountings could allow use of direct torque electric motors to rotate the thruster motors. FIG. 5 is a side elevational view of a partly broken away lateral thruster that uses direct torque electric motors 60*a*–60*d* to rotate the thruster motors 16*a*–16*d*. In this view thruster motor 16*d*, direct electric torque motor 60*d*, web plates 44*c* and 44*d*, axial end rods 24*d* and 26*d*, associated bearing mounts 41 and 48, and portions of end plates 42 and 46 have been removed. This arrangement eliminates electric drive motor 28, mounting plate 40, and the drive train components used in the arrangement illustrated in FIG. 2, but otherwise functions the same. The stationary components of direct torque electric motor 60 are fixed to first end plate 42 while the rotational components of direct torque electric motor 60 are attached to axial end rod 26, applying torque to it directly. The direct torque electric motor 60 is likely to require a larger electrical energy source to power it than an electric motor transmitting rotational motion through a gear train electric motor transmitting rotational motion through a gear train arrangement. Battery housing 49 is larger in this arrangement for this reason.

Various arrangements of the thruster motors in accordance with the present invention can be envisioned. There need not be an even number of thruster motors since they are not required to be used in pairs. An arrangement utilizing three thruster motors is viable, for example. If the thruster motors act at or near the center of gravity of the missile, the missile can be translated laterally with little or no pitch or yaw. The missile can thus be maneuvered while it remains pointed at the target. In other arrangements the thrusters can be located forward or aft of the missile center of gravity to provide steering forces as well as lateral or roll forces. For example, the lateral thruster 10 could surround the nozzle of the main rocket motor of a missile, aft of the center of gravity, to provide steering forces.

The use of individually rotatable thruster motors with integral nozzles does away with sealing problems and allows mountings that permit rapid rotation of the thruster motors. This makes improved response time possible for the missile. The thruster motors can be rotated to an anticipated position before they are ignited if exceptionally fast response is required. The thrusters are effective at nearly all aerodynamic angles of attack, missile velocities, and altitudes.

Although there have been described above specific arrangements of a lateral thruster for missiles in accordance with the invention for the purpose of illustrating the manner in which the invention may be used to advantage, it will be appreciated that the invention is not limited thereto. Accordingly, any and all modifications, variations or equivalent arrangements which maY occur to those skilled in the art should be considered to be within the scope of the invention as defined in the annexed claims.

What is claimed is:

1. A lateral thruster for a missile, comprising:
   a plurality of rotatable means for producing thrust, disposed about a longitudinal axis of a missile so that each produced thrust vector lies substantially in a plane transverse to said axis, each said rotatable means for producing thrust comprising an individual thruster motor and an integral nozzle, said integral thruster motor and nozzle being rotatable as a unit about an axis which is transverse to said plane;
   a plurality of means for rotating said means for producing thrust; and
   housing means for supporting said pluralities of means for producing thrust and said rotating means on the missile, said housing means being attached to the missile.

2. The lateral thruster of claim 1 wherein said plane contains a center of gravity of said missile.

3. The lateral thruster of claim 1 wherein said plane is aft of a center of gravity of said missile.

4. The lateral thruster of claim 1 wherein said plane is forward of a center of gravity of said missile.

5. The lateral thruster of claim 1 wherein each said means for producing thrust comprises:
   a reservoir of propellant;
   means for egress of said propellant from said reservoir integral with said reservoir; and
   means for releasing said propellant from said reservoir.

6. The lateral thruster of claim 5 wherein each said reservoir contains a solid fuel.

7. The lateral thruster of claim 5 wherein each said reservoir contains a liquid fuel.

8. The lateral thruster of claim 5 wherein each said reservoir contains a gas under pressure.

9. The lateral thruster of claim 1 wherein said means for producing thrust are disposed symmetrically about said longitudinal axis in said transverse plane.

10. The lateral thruster of claim 1 wherein said nozzles are constrained to rotate independently about respective axes which are generally parallel to said longitudinal axis of said missile.

11. The lateral thruster of claim 1 wherein a direction of propellant flow from each said nozzle is substantially confined to a plane perpendicular to said longitudinal axis of said missile.

12. The lateral thruster of claim 5 wherein each said means for rotating is associated with a separate said means for producing thrust and comprises:

an electrical motor having an output shaft; and coupling means for transmitting a rotation of said output shaft to said means for producing thrust, so that a direction of propellant exiting said means for egress of said propellant from said reservoir is made to rotate about an axis parallel to said longitudinal axis of said missile.

13. The lateral thruster of claim 1 wherein said means for rotating said means for producing thrust is pneumatically actuated.

14. The lateral thruster of claim 1 wherein said means for rotating said means for producing thrust is a direct torque electric motor.

15. A lateral thruster for a missile comprising:

a shroud attached to said missile having an outer contour that blends into a body contour of said missile, said shroud having a plurality of thruster apertures therein;

a structural framework enclosed by said shroud and attached thereto;

a plurality of rotatable thruster motors having first and second axial end rods rotatably mounted on said framework;

a plurality of electrical drive motors having drive shafts rotatably mounted on said framework;

a plurality of means for connecting each said rotatable thruster motor to an electrical drive motor so that said drive motor can effect the rotation of said thruster motor; and electrical energy storage means for energizing said electrical drive motors, attached to said framework and electrically connected to said drive motors.

16. The lateral thruster of claim 15 wherein said structural framework comprises:

a first end plate attached to said shroud;

a second end plate attached to said shroud;

a plurality of bearing mounts on said first end plate in which said first axial end rods of said thruster motors are mounted;

a second plurality of bearing mounts on said second end plate in which said second axial end rods of said thruster motors are mounted;

a plurality of drive shaft bearing mounts on said first end plate in which said drive shafts are mounted;

a mounting plate to which said plurality of drive motors are mounted, said mounting plate being connected to said shroud; and a web of plate-like partitions connected to said shroud, with each said partition separating adjacent thruster motors.

17. The lateral thruster of claim 15 wherein each said connecting means comprises:

a drive gear mounted on said drive shaft of each said drive motor;

a rotator gear mounted on said first axial end rod of each said thruster motor; and an idler gear rotatably engaged between said drive gear and said rotator gear, mounted on an idler gear shaft which is mounted in an idler gear shaft bearing mount in said first end plate.

18. The lateral thruster of claim 15 wherein each said drive motor is an electrical torque motor having an output shaft and each said connecting means comprises a drive gear on said torque motor output shaft meshed with a rotator gear on said first axial end rod of said thruster motor.

19. The lateral thruster of claim 15 wherein said thruster motors are symmetrically disposed about a longitudinal axis of said missile.

20. The lateral thruster of claim 15 wherein each said thruster motor comprises a container member filled with propellant, a nozzle member integral with said container member and directed substantially at right angles to a longitudinal axis of said missile, said plurality of thrust apertures allowing said propellant to be exhausted from said nozzle through said shroud, and a plurality of propellant activation means for causing said propellant to escape from said container means at predetermined times for predetermined time intervals.

21. The lateral thruster of claim 20 wherein said propellant is a solid fuel.

22. The lateral thruster of claim 20 wherein said propellant is a liquid fuel.

23. The lateral thruster of claim 20 wherein said propellant is a compressed gas.

24. The lateral thruster of claim 20 wherein said nozzles are constrained to rotate independently about respective axes which are generally parallel to said longitudinal axis of said missile.

25. The lateral thruster of claim 20 wherein a direction of propellant flow from each said nozzle is substantially confined to a plane perpendicular to said longitudinal axis of said missile.

* * * * *